United States Patent [19]

Engler

[11] 4,332,482

[45] Jun. 1, 1982

[54] FLUID MIXER

[76] Inventor: Kevin G. Engler, 13102 Puget Sound Blvd., Edmonds, Wash. 98020

[21] Appl. No.: 170,808

[22] Filed: Jul. 21, 1980

[51] Int. Cl.[3] ..... B01F 3/10

[52] U.S. Cl. ..... 366/130; 366/605

[58] Field of Search ..... 366/130, 237, 238, 210, 366/211, 343, 605

[56] References Cited

U.S. PATENT DOCUMENTS

| | | | |
|---|---|---|---|
| 1,878,924 | 9/1932 | Will | 366/130 |
| 1,989,019 | 1/1935 | O'Keeffe | 366/130 |
| 2,021,495 | 11/1935 | Anderson | 366/130 |
| 3,224,742 | 12/1965 | Hiser | 366/130 |
| 4,050,678 | 9/1977 | Smith | 366/130 |

*Primary Examiner*—Billy J. Wilhite

*Attorney, Agent, or Firm*—Graybeal & Uhlir

[57] ABSTRACT

A fluid mixer for insertion into a container having the fluid to be mixed is disclosed. The fluid mixer generally comprises an insertion member having an open top and bottom and a perimeter substantially similar and equal to that of the interior of the container having the fluid to be mixed. A plurality of mixing blades are carried on the insertion member with each extending inwardly toward the vertical axis of the container to urge the fluid upwardly or downwardly upon reciprocal rotation of the container about its vertical axis.

9 Claims, 5 Drawing Figures

FLUID MIXER

DESCRIPTION

1. Technical Field

This invention relates to mixing devices, and more particularly to a device for insertion into a cylindrical can or the like containing the substance to be mixed.

2. Background Art

In the prior art, one type of agitator for mixing fluid in a paint can or the like generally comprises a member insertable into the can and rotatable around the bottom of the can when the can is agitated. Such agitators are shown by O'Keefe, U.S. Pat. No. 1,989,019, and Hiser, U.S. Pat. No. 3,224,742. O'Keefe shows an agitator generally comprising a flat plate having a hub extending outwardly therefrom. The hub carries curved blades or veins integral with the hub and located on top of the plate. Hiser discloses an agitator fitting within a cylinder can. The disclosed agitator uses plural arms having angularly downwardly extending scraper elements. The arms are held rigidly in an interconnected relationship with each other by means of a centrally disposed reinforcing plate. The agitators of O'Keefe and Hiser are submerged in the paint can and rest on the bottom of the can making their retrieval from a full can difficult. In addition, these agitators are typically fabricated from a metal or similar material and are somewhat complex in design. As a result, the disclosed agitators typically are not economically produced.

Another type of agitator or liquid stirrer is shown in Smith, U.S. Pat. No. 4,050,678. The disclosed stirrer generally comprises a spanner bar extending across and engageable with the top of the container having the fluid to be mixed. The spanner bar has a pair of parallel blades extending perpendicularly to the bar. The parallel bars are terminated in a transverse blade which defines a spatula-like stirring element. The disclosed stirrer has several problems. By virtue of the fact that it is engaged to the top of the container, the disclosed device is not adapted for use in containers of various sizes or shapes. Another problem of the disclosed device is that it typically is manufactured from metal and therefore may not be economical to produce.

The present invention overcomes these problems of the prior art. By providing an insertion member having a perimeter substantially similar to that of the interior of the container, the insertion member easily and quickly may be inserted and retrieved from the container having the fluid to be mixed. By fabricating the present invention from flexible plastic and by utilizing a relatively simple design with which to agitate the fluid, the insertion member may be manufactured economically. Finally, the flexible nature of the insertion member enables the present invention to be used in connection with any size and shaped container having the fluid to be mixed.

DISCLOSURE OF THE INVENTION

According to one aspect of the present invention, a fluid mixer for insertion into a container having the fluid to be mixed comprises an insertion member having an open top and bottom. The insertion member has a perimeter substantially similar and equal to that of the interior of the container containing the fluid to be mixed. A plurality of mixing blades are carried on the insertion member, with each mixing blade extending inwardly toward the vertical axis of the container. The mixing blades are carried around the perimeter of the insertion member from the top of the insertion member to the bottom to urge the fluid upwardly or downwardly upon reciprocal rotation of the container about its vertical axis.

It is an object of the present invention to provide a fluid mixer easily and quickly insertable into any size and shape container having the fluid to be mixed.

A still further object of the present invention is to provide a fluid mixer ideally suited for repeated use.

A still further object of the present invention is to provide a fluid mixer which thoroughly mixes the fluid.

A still further object of the present invention is to provide a fluid mixer easily removable from a container and cleaned.

A still further object of the present invention is to provide a fluid mixer which may be manufactured economically.

The foregoing, and other objects, features, and advantages of the present invention will become more apparent in light of the detailed description of the preferred embodiments thereof set forth hereafter, and illustrated in the accompanying drawings.

BEST MODE OF CARRYING OUT THE INVENTION

Figure 1:
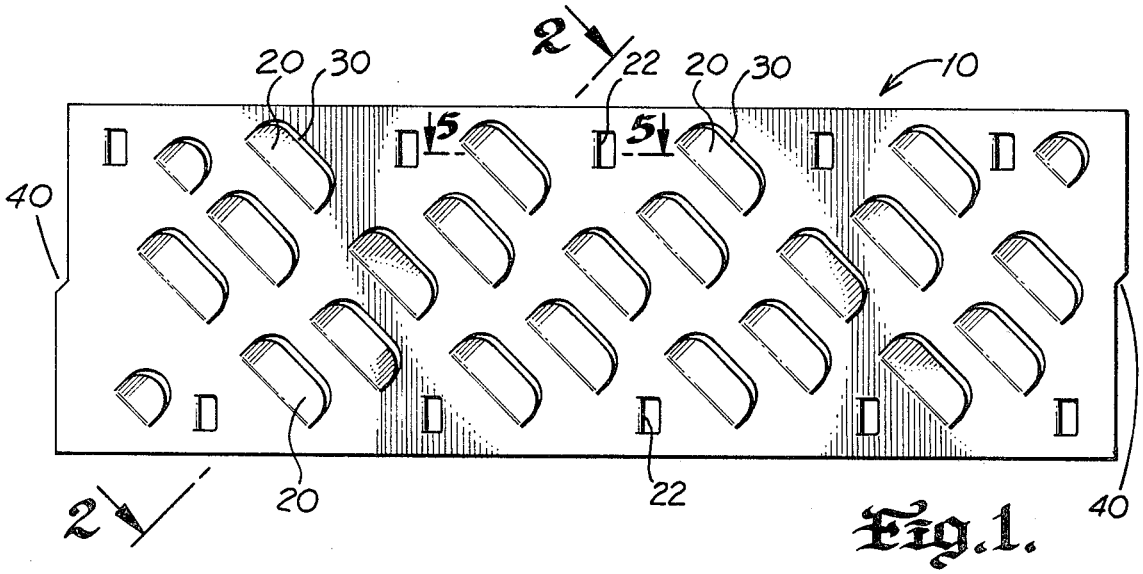
FIG. 1 is a side elevational view of a typical insertion member according to the present invention.

With reference to FIG. 1, a fluid mixer for insertion into a container having the fluid to be mixed comprises an insertion member 10. A plurality of mixing blades, shown generally at 20, are carried on the insertion member and extend inwardly toward the vertical axis of the container. Disposed below each mixing blade is an opening 30 permitting the liquid to be mixed to pass from one side of the insertion member to the other upon reciprocal rotation of the container about its vertical axis.

With reference to FIG. 1, in the preferred embodiment, the insertion member typically is rectangularly shaped, and is constructed from a flexible material such as plastic or the like. The flexible material allows the insertion member to be configured so as to have a shape substantially similar to the interior of the container into which it is inserted. When configured to the shape of the interior of the container, the insertion member has a length substantially equal to the interior perimeter of the container, and a width substantially equal to the height of the container in which the member is placed. The width of the insertion member being at substantially the height of the container enables the insertion member to be easily inserted and removed from a container full of fluid to be mixed. Although in the preferred embodiment the insertion member is constructed from flexible plastic, it is to be understood that other materials having resilient properties, such as semi flexible rubber or the like may be used to practice the present invention without departing from the teachings of the present invention. The use of resilient materials enables the insertion member to be ideally suited for repeated use, and allows the insertion member to be easily cleaned after each use.

Disposed at opposite ends of the insertion member are means, shown generally at 40, with which to assist in preventing the ends of the insertion member from shifting transversely to each other. In the preferred embodiment, the means generally comprise plural and complementary notches carried on extensions disposed at opposite ends of the insertion member. As perhaps best shown in FIG. 4, when the insertion member is flexibly configured to the shape of the interior of the container having the fluid, the extensions are overlapped interlocking the complementary notcher thereby locking the insertion member in the shape of the container. Other means such as snap-type fasteners or the like may be used to maintain the insertion member to the desired shape of the interior of the container or adjust the insertion member in size so as to be insertable into containers of various sizes and shapes.

Figure 2:
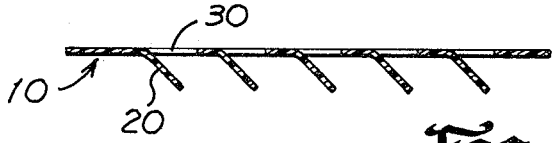
FIG. 2 is a cross-sectional view of the insertion member shown in FIG. 1 taken along lines 2—2.
Figure 3:
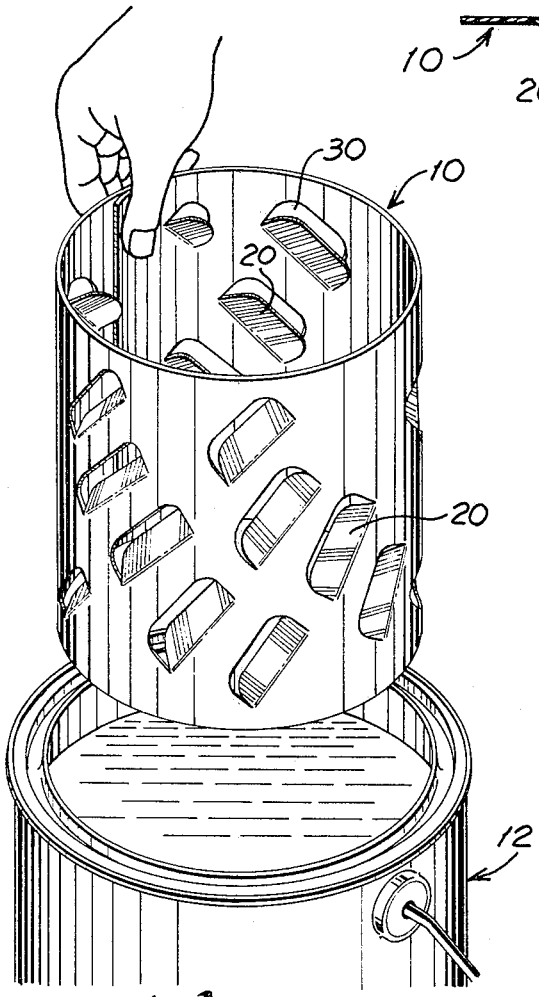
FIG. 3 is a perspective view showing a typical insertion member being inserted into the container having the fluid to be mixed.

The insertion member carried a plurality of mixing blades shown generally at 20. With reference to FIGS. 2 and 3, when the insertion member is configured to the interior shape of the container, the mixing blades extend inwardly toward the vertical axis of the container. The mixing blades are carried on the insertion member around the perimeter of the insertion member with the mixing blades extending from the top of the insertion member to the bottom. In this manner, when the insertion member is placed in the container having the fluid to be mixed, the mixing blades extend the depth of the container. Each mixing blade extends at an acute angle with respect to the planar face of the insertion member and with respect to the vertical axis of the container to ensure the fluid within the container is completely and thoroughly mixed upon reciprocal rotation of the container about its vertical axis. For example, as the fluid to be mixed passes across and over one blade, it is urged upwardly until it impinges upon the blade immediately above the lower blade. The thrust imparted to the fluid by the lower blade is stopped by the upper blade allowing the fluid to travel in a horizontal direction as viewed from the vertical axis of the container. The fluid immediately is caught by another mixing blade and again forced upwardly. The process is repeated along the perimeter of the container since the plurality of mixing blades are working simultaneously with each other. When the direction of rotation of the container is reversed, the process is repeated in an opposite direction forcing the fluid downwardly toward the bottom of the container. This allows any solid compounds within the fluid that may have settled to the bottom of the container to be agitated by the downward thrust of the fluid. As the rotation of the container is reversed, the solid compounds are forced upwardly resulting in the complete and total mixing of the fluid. As shown in FIGS. 1 and 2, in the preferred embodiment, the mixing blades are carried on the insertion member along a plurality of rows each being parallel to the other. Although the mixing blades are shown in the preferred embodiment as having a slightly rounded appearance, it is to be understood that other shapes and sizes of mixing blades may be used to practice the present invention.

Figure 5:
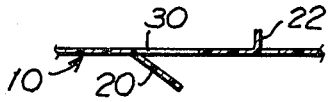
FIG. 5 is a fragmentary, cross-sectional view of the insertion member shown in FIG. 1 taken substantially along lines 5—5 thereof and specifically illustrating the construction of the standoffs.
Figure 4:
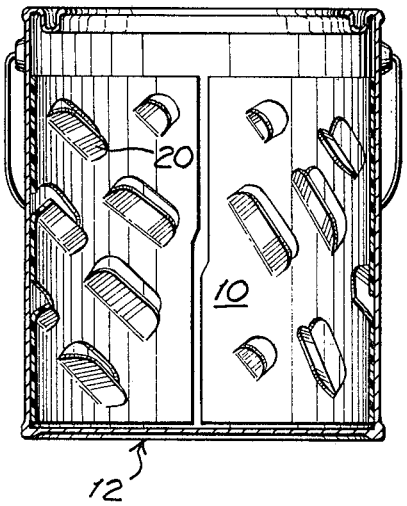
FIG. 4 is a sectional view showing a typical insertion member.

As best shown in FIGS. 3 and 4, disposed below each mixing blade is an opening of substantially the same area as the mixing blade. In this manner, when the insertion member is inserted into the container and the container is reciprocally rotated, fluid to be mixed passes from one side of the insertion member to the other thereby facilitating the mixing process. In an alternate embodiment, the insertion member carries a plurality of standoffs 22 (see FIGS. 1 and 5) which engage the interior of the container and allow a space between the insertion member and the container. The standoffs extend at an acute angle with respect to the planar face of the insertion member and outwardly from the insertion member in a direction away from the mixing blades.

As previously discussed, the insertion member typically is constructed from flexible plastic. By using a sharp pointed knife or the like, and by "scoring" the plastic, mixing blades and the standoffs may be etched on the insertion member. When the "scored" portions are fractured such as by applying pressure from behind, the mixing blades and the openings and the standoffs are formed. Thus, the insertion member may be quickly and economically manufactured.

I claim:

1. A fluid mixer for insertion into a container having the fluid to be mixed comprising:

(a) a flexible, nominally flat insertion member:
- being configurable into a tubular shape approximating the shape of the container;
- when inserted into the container, said insertion member pressing against the interior of the container;
- and when inserted into the container, said insertion member having an open top and bottom and a perimeter substantially similar to the interior of the container; and (b) a plurality of mixing blades carried on the insertion member extending inwardly toward the vertical axis of the container with the mixing blades being carried around the perimeter of the insertion member from the top of the insertion member to the bottom thereof to urge the fluid upwardly or downwardly upon reciprocal rotation of the container about its vertical axis.

2. The fluid mixer of claim 1, wherein the insertion member has a plurality of openings disposed below each mixing blade permitting the liquid to be mixed to pass from one side of the insertion member to the other upon reciprocal rotation of the container.

3. The fluid mixer of claim 2, further comprising a plurality of standoffs extending outwardly from said insertion member in a direction away from the vertical axis of the container to abut against the interior of the container in which said fluid mixer is inserted to thereby space said insertion member inwardly from the interior of the container.

4. The fluid mixer of claim 1, wherein the plurality of mixing blades are carried on the insertion member in a plurality of rows each being parallel to the other.

5. The fluid mixer of claim 1, wherein the insertion member is nominally rectangularly shaped having a length substantially equal to the interior perimeter of the container, with the ends of the insertion member being of a width substantially equal to the height of the container, the insertion member including means disposed at its opposite ends to prevent the opposite ends of the insertion member from shifting transversely when the insertion member is configured into the shape of the container.

6. A fluid mixer for insertion into a cylindrical can comprising:

(a) a flexible, nominally planar insertion member, said insertion member:

being curlable into a cylindrical shape approximately the shape of the cylindrical can;

when inserted into the can, said insertion member pressing against the interior of the can; and when inserted into the can, said insertion member having an open top and bottom, a circumference substantially equal to the circumference of the interior of the cylindrical can, and a height substantially equal to the height of the interior of the cylindrical can; and (b) a plurality of mixing blades carried on the insertion member in a plurality of rows each being parallel to the other, each mixing blade extending inwardly toward the vertical axis of the cylindrical can with the mixing blades being carried circumferentially around the insertion member from the bottom of the insertion member to the top thereof to urge the fluid upwardly or downwardly upon reciprocal rotation of the can about its vertical axis.

7. The fluid mixer of claim 1, wherein the insertion member has a plurality of openings disposed below each mixing blade permitting the liquid to be mixed to pass from one side of the insertion member to the other upon reciprocal rotation of the cylindrical can.

8. The fluid mixer of claim 6 or 7, further comprising a plurality of standoffs extending outwardly from said insertion member in a direction away from the vertical axis of the cylindrical can to press against the wall of the can to thereby space said insertion member inwardly from the wall of the can.

9. The fluid mixer of claim 6, wherein the insertion member includes means at its opposite ends to overlap opposite end portions of the insertion member to prevent the ends of the insertion member from shifting transversely relative to each other.

* * * * *